United States Patent [19]

Saxon et al.

[11] Patent Number: 4,467,798

[45] Date of Patent: Aug. 28, 1984

[54] TRANSPORTABLE HYPERBARIC LIFE SUPPORT CHAMBER

[75] Inventors: Ross E. Saxon, Spring; W. Robert Bryant, Houston, both of Tex.

[73] Assignee: Nautilus Environmentals, Inc., Houston, Tex.

[21] Appl. No.: 330,339

[22] Filed: Dec. 14, 1981

[51] Int. Cl.[3] ..... A61M 16/02

[52] U.S. Cl. ..... 128/205.26; 128/202.12

[58] Field of Search ..... 128/202.12, 205.26, 128/1 B, 30.2, 201.27; 405/8, 189, 192, 193; 114/335, 201 R, 203; 76/145; 292/57, 59, 63, 67, 68; 49/68; 220/325, 244, 243, 327; 296/20; 285/158, 189, 192

[56] References Cited

U.S. PATENT DOCUMENTS

| | | | |
|---|---|---|---|
| 803,687 | 11/1905 | Grotewohl | 285/158 |
| 2,335,450 | 11/1943 | Sandberg | 405/8 |
| 3,367,308 | 2/1968 | Quattrone et al. | 128/202.12 |
| 4,135,690 | 1/1979 | MacQuilkin et al. | 220/327 |
| 4,227,524 | 10/1980 | Galerne | 128/205.26 |
| 4,230,107 | 10/1980 | Butler | 128/205.26 |
| 4,247,091 | 1/1981 | Glowacki et al. | 269/325 |
| 4,376,352 | 3/1983 | Soininen et al. | 49/68 |

*Primary Examiner*—Henry J. Recla
*Assistant Examiner*—Karin M. Reichle
*Attorney, Agent, or Firm*—Pravel, Gambrell, Hewitt, Kirk & Kimball

[57] ABSTRACT

A transportable hyperbaric chamber which is generally cylindrical in configuration and has a manway opening at one end, the chamber being of sufficient length and diameter to receive an injured person. The chamber is adapted to be temporarily connected to a deck chamber or other emergency chamber to receive an injured person and to subsequently be connected to a hospital or other more permanent chamber wherein such person may be treated over a longer period. The chamber is mounted on a support platform which is vertically adjustable at various points in order to align the chamber with such deck and hospital chambers. A pressure safe chamber door is mounted interiorly of the chamber and is movable between a closed, sealed position and an open position wherein the door is fully out of the path of the manway so that an injured person may be transferred without obstacle.

10 Claims, 12 Drawing Figures

15
75
79
76b
81a
81
81c
80
83
80a
77
14d
78
14e
71
82
5
41
14f
54
70
72
4
10a
51
52
40
53
19a
55
41a
50
43
59
61
57
56
58
60
19
19a
64
4
42
19b
18
5

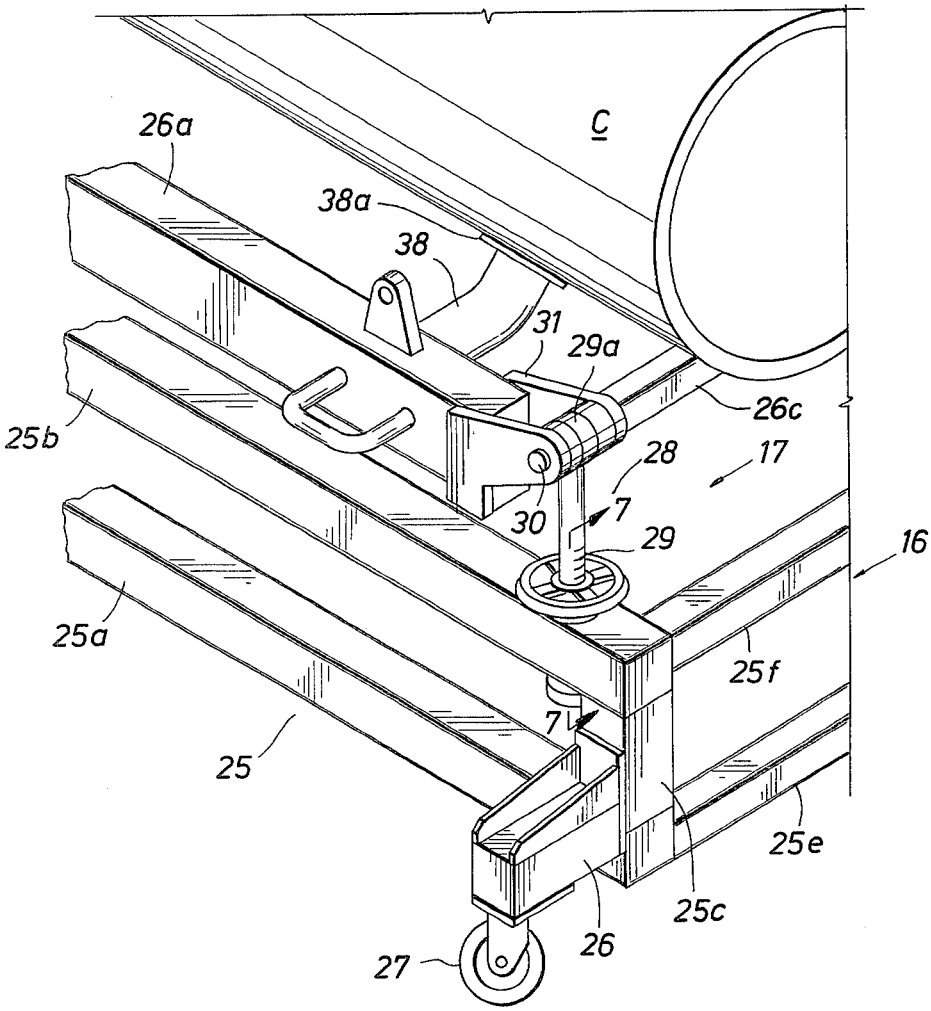
FIG.6
FIG.7
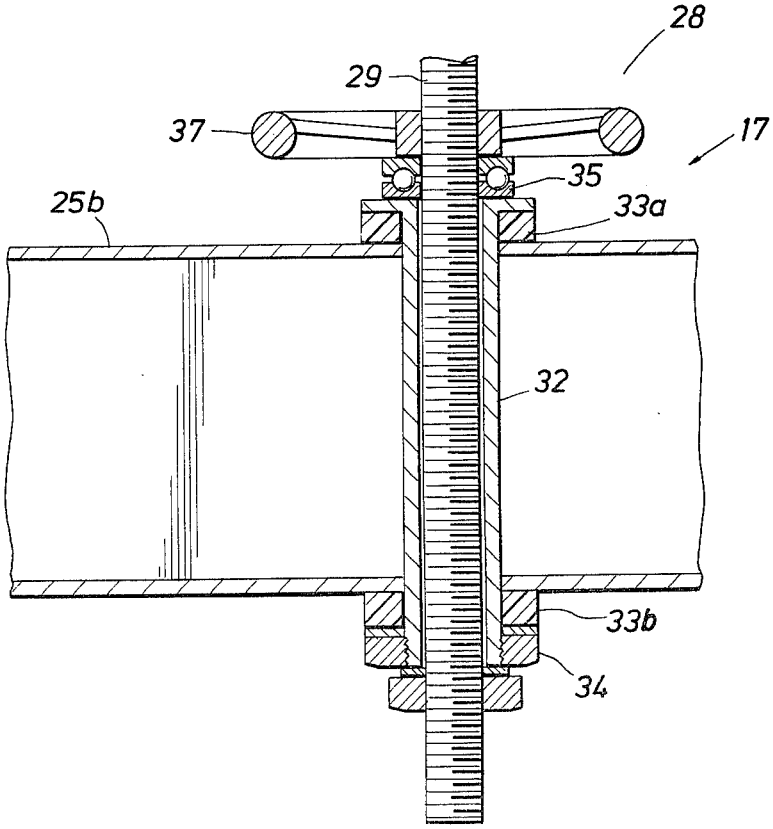

FIG.10
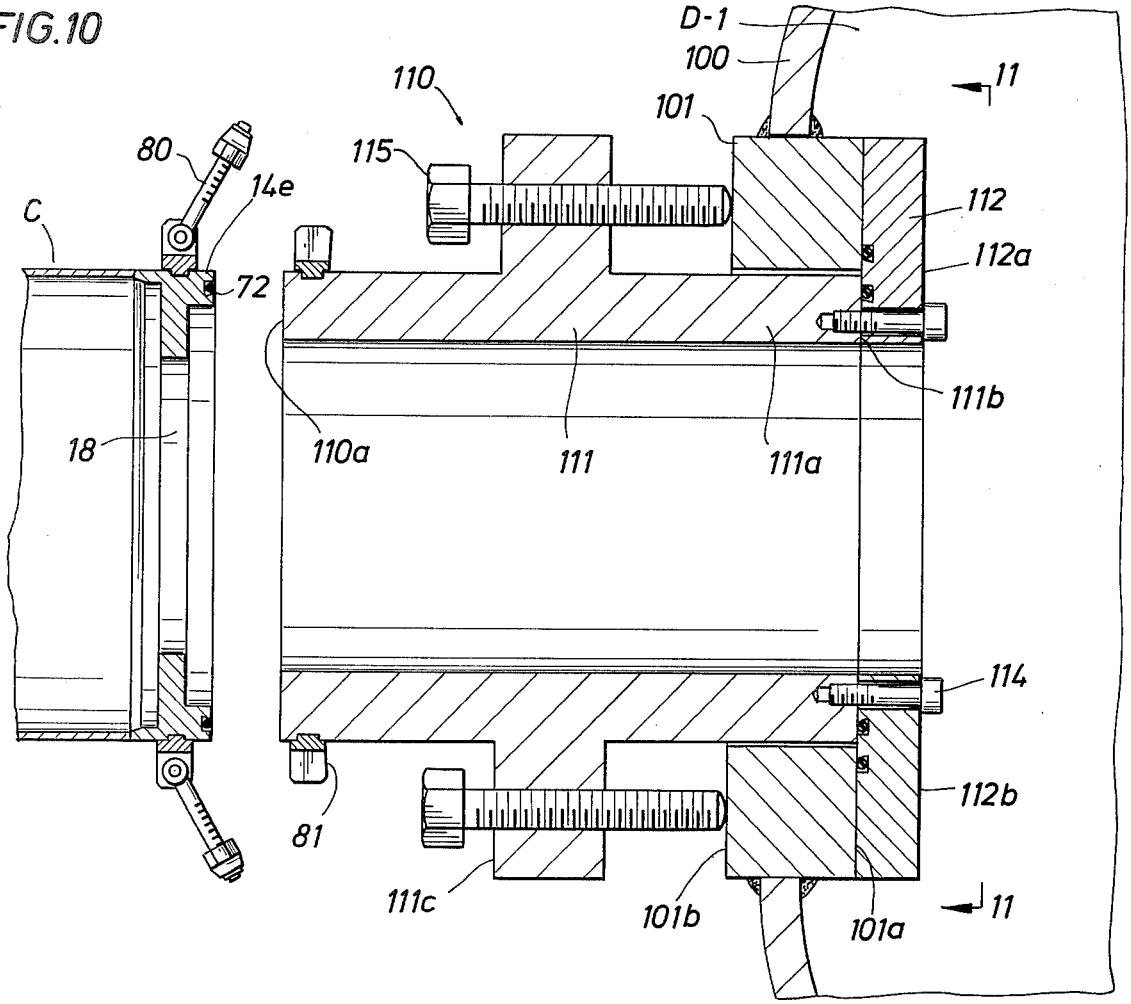
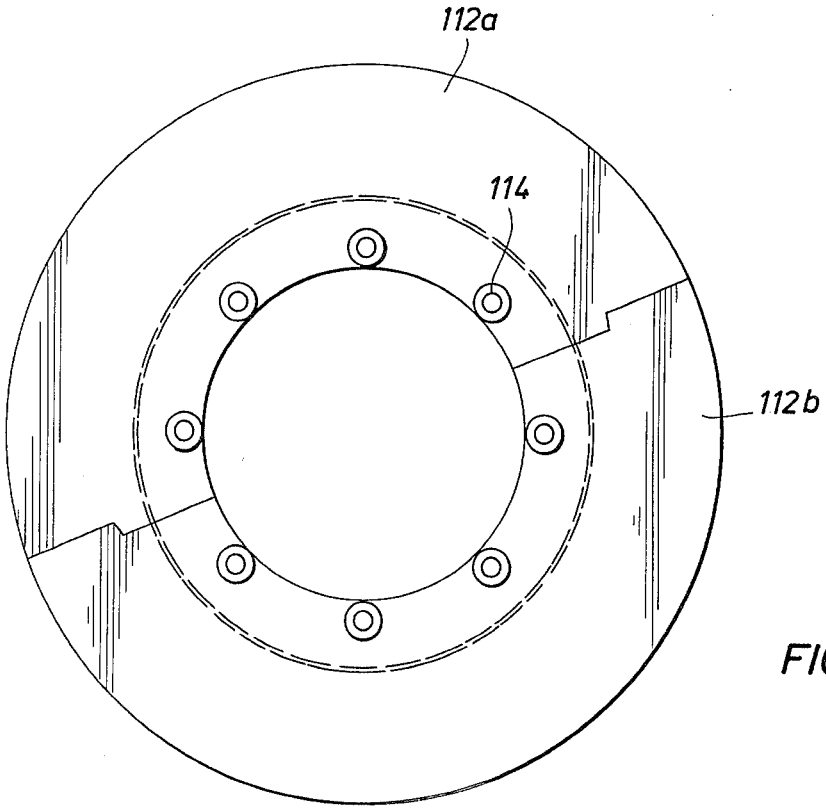
FIG.11

TRANSPORTABLE HYPERBARIC LIFE SUPPORT CHAMBER

TECHNICAL FIELD OF THE INVENTION

The field of this invention relates to hyperbaric chambers.

Hyperbaric or high pressure chambers are known to have important medical uses. Perhaps the most vivid example of the use of hyperbaric chambers is in the treatment of divers who are suffering from "bends" or nitrogen narcosis. It is well known that isolation of such injured diver in a high pressure atmosphere is one of the few known treatments for this often fatal or crippling malady. Even as well known as hyperbaric treatment is in situations where a diver has surfaced too quickly and begins to suffer from bends, too few hyperbaric treatment centers are available for such divers. Oftentimes, diving vessels have no hyperbaric treatment center or chambers at all. And, even if a vessel or offshore platform has some type of hyperbaric chamber on it, it is generally insufficient for any type of long term treatment. The only available chambers for long term treatment are located at hospitals and medical centers often far away from the scene of a diving accident. And, a diver may be already permanently injured if not dead by the time he is transported to such a suitable hyperbaric chamber facility. For even if a diver receives some temporary treatment on a vessel or offshore platform, the benefits of that temporary treatment may be lost in a period of transfer of the diver to a more permanent treatment area.

In addition to the diver bend treatment, medical researchers are experimenting with hyperbaric pressure treatments and it is generally felt that new uses for hyperbaric chambers are in the offing.

SUMMARY OF THE INVENTION

It is an object of this invention to provide a transportable hyperbaric life support chamber which can be utilized to carry a diver or other injured person to a hospital or other permanent chamber site and to allow such injured person to be safely transferred into such chamber, all at hyperbaric pressure.

The transportable hyperbaric chamber of the preferred embodiment of this invention is generally cylindrical in configuration and has a manway opening at one end, the overall length and diameter of the transportable hyperbaric chamber being sufficient to receive an injured person. The transportable hyperbaric life support chamber includes a chamber interconnection means for temporarily connecting the transportable hyperbaric chamber first to a deck chamber so that an injured person can be transferred from the deck of a ship or the like to the transportable chamber and subsequently to connect the transportable hyperbaric chamber to a hospital chamber so that the injured person can be transferred to such chamber for treatment on a more permanent basis. A chamber support platform is provided for supporting the transportable chamber itself in an aligned position with respect to the deck chamber or hospital chamber. A pressure safe chamber door is positioned within the transportable hyperbaric chamber and is of sufficient size to cover the manway and is movable between a closed position and an open position fully out of the path of the manway so that an injured person can be moved therethrough without obstruction. And, a stretcher support assembly is mounted within the transportable hyperbaric chamber for moving an injured person positioned on a stretcher into and out of the chamber.

The description just outlined is only a summary of the features of this invention, which will be described in more detail hereinafter.

BRIEF DESCRIPTION OF THE DRAWINGS

FIG. 6 is a perspective view of the transportable chamber dolly illustrating the alignment mechanism therefore;

FIG. 7 is a sectional view taken along line 7—7 of FIG. 6 illustrating the mounting details of the vertical position adjustment mechanism for the dolly;

FIG. 10 is a sectional view of a seal adapter; and

FIG. 11 is an end view taken along line 11—11 of FIG. 10 of such seal adapter.

DESCRIPTION OF THE PREFERRED EMBODIMENT

Figure 1:
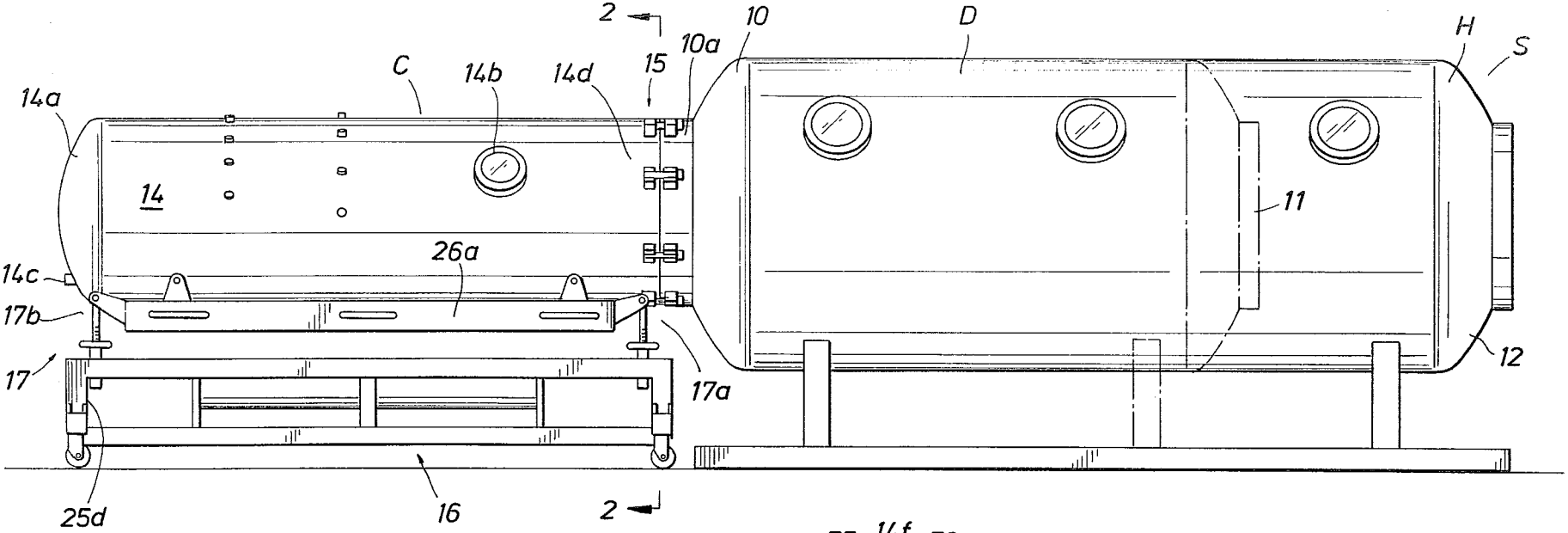
FIG. 1 is a side view of the transportable hyperbaric life support chamber of the preferred embodiment of this invention illustrated in temporary attachment with either a deck chamber or a hospital chamber.

A hyperbaric chamber system generally designated by the letter S is illustrated in FIG. 1. The hyperbaric chamber system S includes the transportable hyperbaric life support chamber C of the preferred embodiment of this invention which is adapted to be attached to the deck chamber D or to a hospital chamber H. The deck chamber D is a chamber which may be mounted onto the deck of a ship, an offshore platform or is located at some other site remote from a hospital or other emergency medical facility where the hospital chamber H is located. As illustrated in FIG. 1, the deck chamber D is of the same overall diameter as the hospital chamber H and thus for the purposes of illustration, the end portion 10 of both the deck chamber D and hospital chamber H is identical. The deck chamber D is illustrated as being shorter and thus terminates in end portion 11 which is illustrated in broken lines. The end portion 12 for the hospital chamber H is illustrated in solid lines thus indicating the overall greater length of the hospital chamber H. Typically, the overall diameter of the deck chamber D and the hospital chamber H is substantially greater than the diameter of the transportable hyperbaric chamber C so that more than one injured person may be maintained within the chambers D and H or so that an injured person may be kept therein for a substantial period of time and medical personnel may also be somewhat free to move about and care for such injured person. It is contemplated that the hospital chamber H will be located within a hospital or a medical facility so that proper, more permanent and extensive medical care may be available to an injured person such as a diver suffering from bends. The purpose of the transportable hyperbaric chamber C is to receive an injured person from a chamber such as the deck chamber D and allow such injured person to be tranported to a more permanent medical assembly where the hospital chamber H is located while at the same time maintaining such person under hyperbaric pressure.

The transportable hyperbaric chamber C is a vessel which is generally cylindrical in configuration and is of sufficient length and diameter to receive an injured person. The chamber C includes a main cylindrical shell portion 14 having at one end a dome-shaped closed head 14*a*. The chamber shell includes several view ports such as 14*b* and a plurality of electrical and gas openings such as the opening 14*c* in head 14*a* for providing oxygen and power to necessary life support equipment located within the chamber C.

The transportable hyperbaric chamber C includes end portion or head 14*d* adapted to be mounted in aligned, sealed engagement with a corresponding end portion or head 10*a* on the deck chamber D or hospital chamber H. The end portion 14*d* of the chamber C has mounted therewith a chamber interconnection means generally designated by the number 15 for temporarily attaching the chamber C to either of the chambers D or H so that an injured person can be transferred from the deck chamber D to the transportable chamber C and subsequently, after transfer of the chamber to a hospital location, the chamber C can be temporarily connected to a hospital chamber H.

Figure 1A:
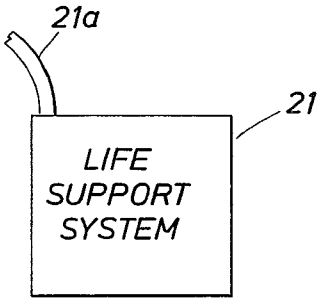
FIG. 1*a* is a schematic of a life support system which may be used with the transportable hyperbaric chamber.

A chamber support platform generally designated as 16 is provided for supporting the chamber C in an aligned position with either of the chambers D or H. The platform or dolly 16 includes vertical position adjustment means generally designated 17 for adjusting the vertical position of the chamber C with respect to the chambers D or H. The chamber end 14*d* terminates in an annular rim 14*e* (FIGS. 2 and 3) and a transverse end section 14*f* forming a manway 18. A pressure safe door 19 is adapted for moving between a closed, sealed position over the manway 18 to an open position fully out of the path of the manway so that an injured person can be transferred through the manway without obstruction. A stretcher support assembly 20 (FIGS. 8 and 9) is mounted within the shell 14 of the chamber C for supporting an injured person and moving that injured person in and out of the chamber C. In FIG. 1*a*, a life support system generally designated as 21 is illustrated showing one of its connection lines or hoses 21*a* extending toward the chamber C. The life support system 21 includes various life support equipment such as air filtering equipment for removing carbon monoxide, all of which equipment being powered by battery so that it is capable of operating independently of any power supply. The equipment for the life support system is otherwise well known and may be varied as needed to properly provide medical support for the chamber C whenever, due to circumstances, it is necessary to keep an injured person within the chamber C for a more extended period.

Referring principally to FIG. 6 and also to FIGS. 1, 2, 6 and 7, the chamber support platform or dolly 16 provides support for the chamber C and, through the vertical position adjustment means 17, provides means for adjusting the relative vertical position of each end and corner of the chamber C in order to adjust and align the position of the chamber C with respect to the chambers D or H. The support dolly 16 includes a generally rectangular main frame 25 including oppositely positioned, longitudinally directed main frame members 25*a* and 25*b* which are connected to each other by frame post 25*c* and 25*d* thus forming one side of the main frame 25. The other side of the main frame, not shown in detail in the drawing, includes identical frame members, the frame members for each side being interconnected by transverse frame members such as the frame members 25*e* and 25*f* illustrated in FIG. 6. This generally rectangular main frame 25 further includes wheel support assemblies 26 having wheels 27 for engaging the ground and providing a rolling support for the chamber C.

Figure 2:
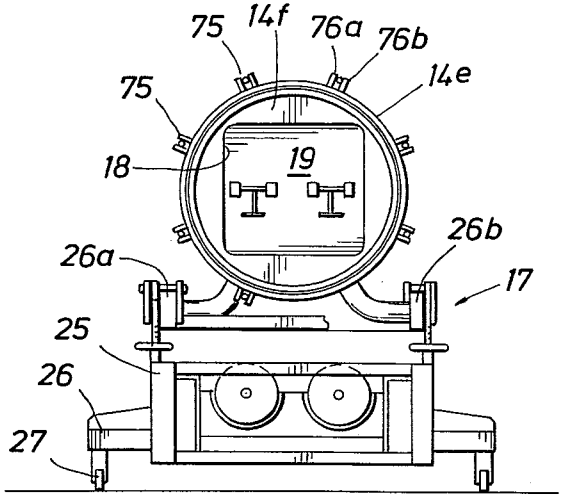
FIG. 2 is an end view of the manway end of the transportable hyperbaric chamber.

The vertical position adjustment means 17 provides a vertically adjustable, pivotal connection between the main frame members 25*b* and oppositely positioned intermediate frame members 26*a* and 26*b* (FIG. 2). The intermediate frame members 26*a* and 26*b* extend longitudinally with respect to the longitudinal axis of the chamber C and are positioned on each side of the chamber C and below it. The intermediate longitudinal frame members 26*a* and 26*b* are interconnected by transverse frame members such as 26*c*.

The vertical position adjustment means 17 includes first and second sets 17*a* and 17*b* (FIG. 1), respectively, of adjustment mechanisms positioned at the ends 14*d* and 14*a*, respectively, of the chamber C for adjusting the vertical position of the chamber for alignment with the end lO*a* of the chambers D and H. Each of the longitudinally spaced sets 17*a* and 17*b* of adjustment mechanisms include two, oppositely positioned, vertically adjustable chamber support assemblies 28.

Referring the FIGS. 6 and 7, a chamber support assembly 28 is illustrated in detail. The chamber support assembly 28 includes a threaded shaft 29 having at its upper end a circular portion 29*a* which mounts over pin 30 extending between spaced mounting lugs 31 attached to an end of the intermediate frame member 26*a*. The threaded shaft 29 extends downwardly through a supporting sleeve 32 mounted by gaskets 33*a* and 33*b* in the main frame member 25*b*. The sleeve 32 is held in place by a nut 34 mounted over a bottom portion of the threaded shaft 29 in threaded engagement with the sleeve 32. A ball bearing 35 is fitted over an upper portion of the threaded shaft 29 immediately above the top of the sleeve 32 to support for rotation a hand wheel 37 which is mounted over and in threaded engagement with the threaded shaft 29. The relative vertical position of an end portion of the intermediate frame member 26*a* is adjustable by turning the hand wheel 37 which in turn adjusts the relative position of the threaded shaft 29 with respect to the main frame member 25*b*. The pivotal connection of the threaded shaft 29 to the end of the intermediate frame member 26*a* provides for individual adjustment of the intermediate frame members at each end so that each end and each side of the intermediate support structure formed by the intermediate frame members 26*a* mounted on each side of the chamber C is adjustable. The intermediate frame members 26*a* are in direct alignment with and positioned above the frame members 25*b* so that the threaded shafts 29 support the load of the chamber C which rests on the intermediate frame members through four inwardly directed support arms 38 which are welded onto and extend inwardly from the intermediate frame members 26*a*. Each support arm 38 terminates in a pad 38*a* having an inclined surface for receiving the surface of the chamber shell 14.

Figure 3:
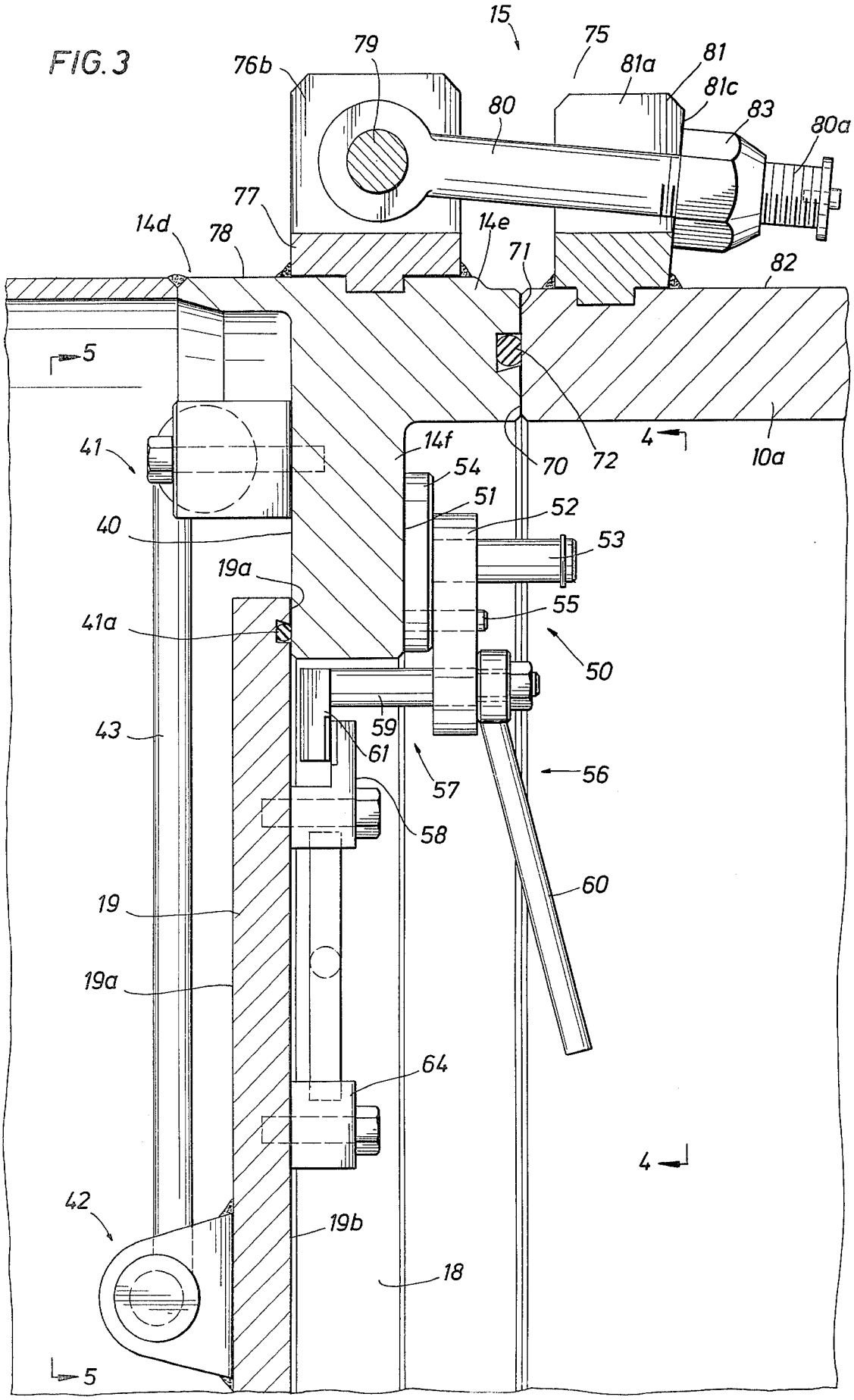
FIG. 3 is a sectional view of the pressure safe chamber door in a closed and locked position and of the chamber interconnection mechanism for connecting the transportable hyperbaric chamber to a deck or hospital chamber.

The chamber end 14*d* has been previously described as terminating in an annular rim 14*e* and a transversely extending wall section 14*f*. Referring to FIG. 3, these sections 14*c* and 14*f* are integrally formed out of a single ring and welded to the shell 14. The manway 18 is a generally square opening in the transversely extending wall section 14*f*. The pressure safe door 19 is also approximately square in configuration and is larger in overall size that the manway 18 so that the door includes a square rim portion 19*a* which overlaps with and engages the interior surface 40 of the transverse wall section 14*f*. A seal ring 41*a* is mounted in a groove extending in a square-like pattern throughout this overlapping rim section 19*a* so that the door in the closed positioned illustrated in FIG. 3 may be held in sealed engagement with the inside surface 40 of the wall section 14*f*. Of course, since the chamber is hyperbaric, the pressure within the chamber will be sufficiently great to press the door 19 into such sealed engagement against surface 40.

Figure 8:
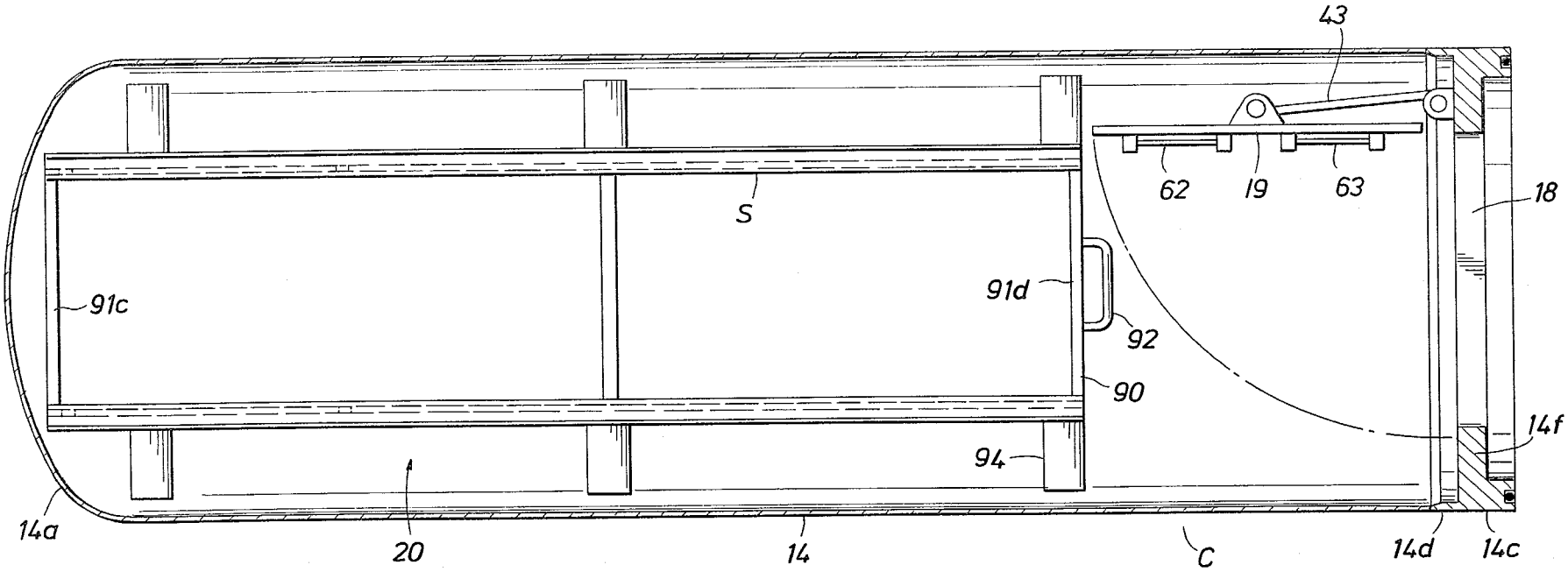
FIG. 8 is a partly sectional view across the top of the transportable hyperbaric chamber illustrating the pressure safe chamber door in an open position and the stretcher support assembly.
Figure 9:
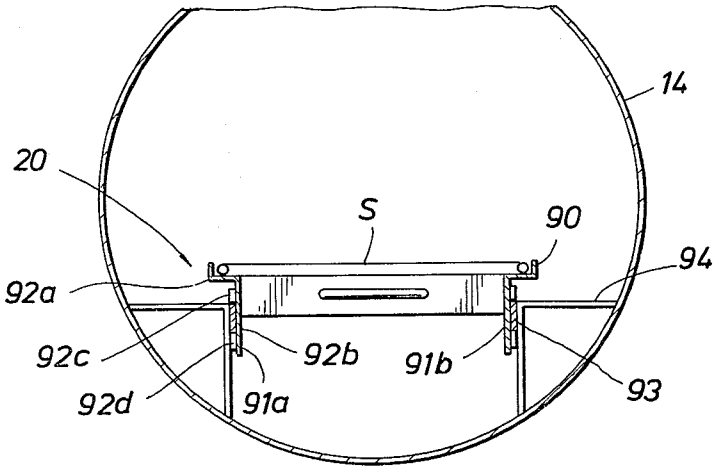
FIG. 9 is an end view of the stretcher support assembly.

The pressure safe door 19 is movable between the closed position illustrated in FIG. 3 and an open position illustrated in FIG. 8. First pivot mount means 41 and second pivot mount means 42 are mounted with the transverse wall section 14*f* and with the pressure safe door 19 and are interrelated to each other in order to move the pressure safe door from the closed position of FIG. 3 in which the door is transversely positioned, parallel to and in sealed engagement with the wall section 14*f* to the open position illustrated in FIG. 8. In the open position, the pressure safe door 19 is moved to a position which is out of the way of the path of the manway 18 so that an injured person can be moved through the manway 18 without obstruction. The first pivot means 41 is attached to a door arm 43 and to the interior surface 40 of the wall section 14*f* for moving the door arm 43 between a first position in which the door arm is also positioned transversely with respect to the chamber C (FIG. 3) to a second position (FIG. 8) wherein the door arm 43 is positioned at a slight angle with respect to the longitudinal axis of the chamber C. The second pivot means 42 is attached to the interior surface 19*a* of the pressure safe door 19 and to the door arm 43 for mounting the pressure safe door for pivotal movement with respect to the door arm.

Figure 5:
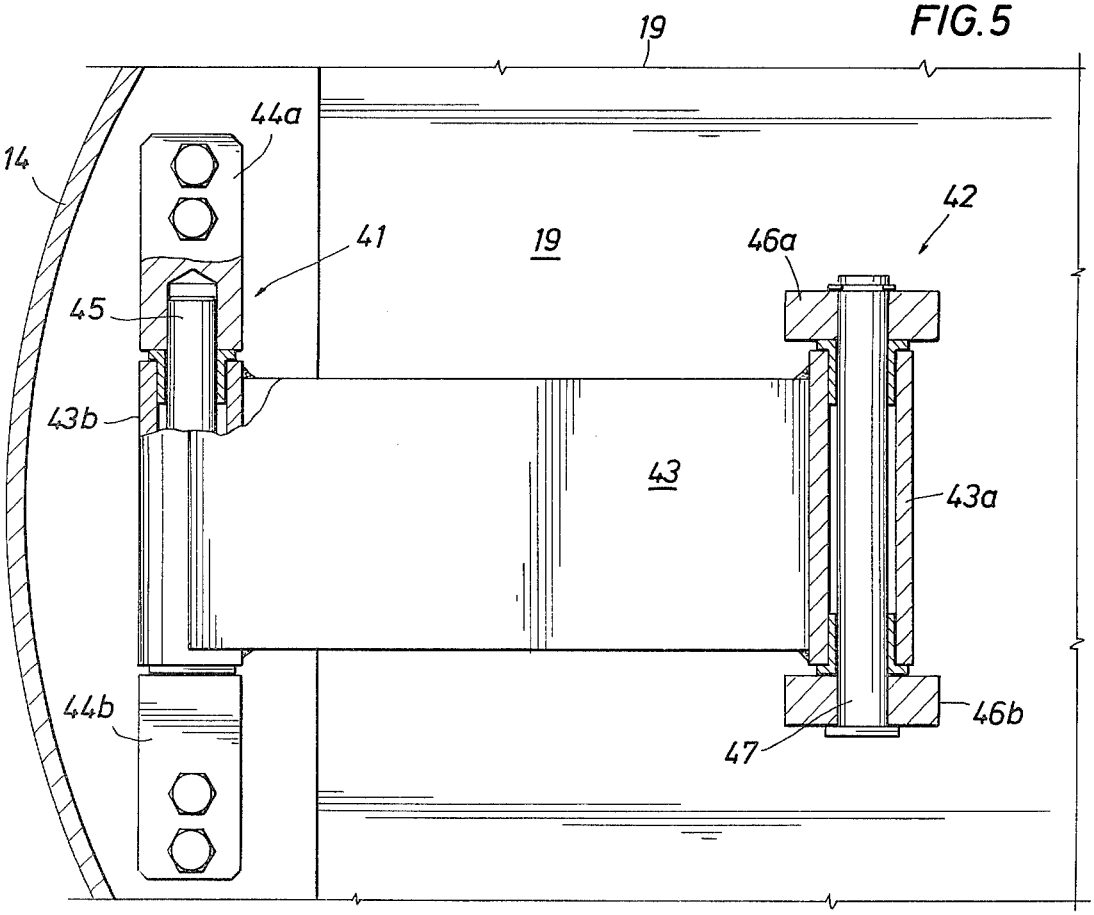
FIG. 5 is an end view taken along line 5—5 of FIG. 3 illustrating the pivotal mounting of the pressure safe chamber door.

The door arm 43 is actually a rectangular plate as viewed in FIG. 5 and is welded to one sleeve 43*a* for connection to the second pivot means 42 and to another sleeve 43*b* for connection to the first pivot means 41. The first pivot means 41 includes upper and lower bracket members 44*a* and 44*b* which are bolted into the inside surface 40 of the transverse wall section 14*f* in order to mount a pin 45 which extends through the door arm sleeve 43*b* in order to pivotally mount the door arm for movement as described. The second pivot mount means 42 includes first and second mounting brackets 46*a* and 46*b* which are welded onto the inside surface 19*a* of the pressure safe door 19 and mount therein a pin 47 which extends through the door arm sleeve 43*a* in order to mount the pressure safe door 19 for pivotal movement with respect to the door arm 43.

Figure 4:
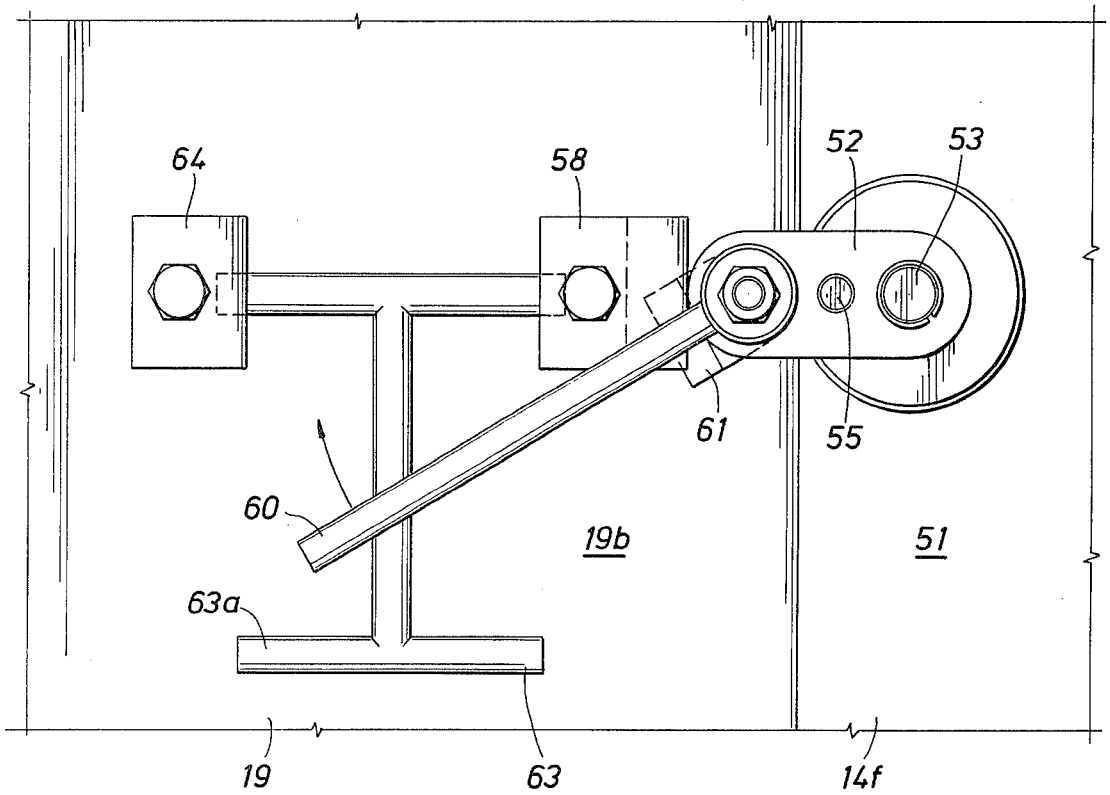
FIG. 4 is a partial end view taken along 4—4 of FIG. 3 illustrating the pressure door locking mechanism.

Referring in particular to FIGS. 3 and 4, a latch means generally designated as 50 is mounted onto the transverse wall section 14*f* for engagement with the pressure door 19 for locking the pressure safe door in a closed position. For the purposes of further definition, the pressure safe door includes an outside surface 19*b* and the transverse wall section 14*f* has outside surface 51. A pivotally mounted link 52 is mounted on base member 54 for pivoted movement by pin 53 which is also mounted into outside surface 51 of the wall section 14*f*. The lockable link 52 is thus movable between a position out of the way of the manway 18 and a locked, transversely extended position wherein the link extends basically horizontally toward the pressure safe door 19. Further, the lockable link 52 may be removed by removing the snap ring on the pin 53 if desired. The lockable link 52 is held in its transverse position by a movable link set or pin 55 which extends through an opening in the link 52 into an opening in the base member 54 which is actually mounted into the outside wall 51 of the transversely extending wall section 14*f*.

A lock handle assembly generally designated as 56 is mounted onto the lockable link 52 for pivotal movement with respect to the link. The lock handle assembly 56 includes a latch means generally designated as 57 extending into the man way 18 and into locking engagement with a mating latch element 58 mounted on the exterior wall 19*b* of the pressure safe door 19. The lock handle assembly 56 includes a shaft 59 which extends longitudinally into the manway 18 and is pivotally mounted into the lockable link 52 and has a handle 60 bolted onto one end thereof so that the shaft 59 is rotatable by the handle 60. The latch means 57 includes the latch element 61 which is mounted onto the other end of the shaft 59 and extends transversely to the shaft for engagement with an inside surface of the mating latch element 58 bolted into the exterior wall 19*b* of the pressure safe door 19. When it is necessary to lock the pressure safe door 19 in the closed position, the lockable link 52 is set by the setting pin 55 so that the link 52 is transverse to and extends into the path of the manway 18. The handle 60 is rotated as illustrated in FIG. 4 to move the latching element 61, which extends into the manway 18, into frictional and mating engagement with the mating latch element 58 attached to the door 19.

The pressure safe door 19 has several handles 62 and 63 mounted thereon for pulling the door to a closed position. Each of the handles 62 and 63 include T-shaped handle members such as 63*a* pivotally mounted into the door exterior wall 19*b* by bolted mounting brackets such as 64.

Referring to FIG. 3, the end portion 10*a* of the deck chamber D and hospital chamber H is annular in configuration and terminates in an annular face 70 adapted to engage an annular face 71 on the similarly size and aligned annular rim 14*e* of the chamber C. The annular rim 14*e* has an annular groove machined in the surface 71 which mounts an O-ring type of sealing element 72 which sealably engages the annular face 70 of annular rim or end portion 10*a* of the chambers D or H.

The chamber interconnection means 15 for temporarily connecting the transportable hyperbaric chamber C to the deck chamber D and to the hospital chamber H includes a plurality of circumferentially spaced camming connectors 75 illustrated in detail in FIG. 3. Each of the camming connectors 75 are identical except for circumferential spacing about the annular rims 14*e* and 10*a* of the chambers C and D or H. Each of the circumferentially spaced camming connectors 75 include spaced mounting tabs 76*a* and 76*b* (FIG. 2) which form part of a U-shaped mounting member 77 welded into the exterior surface 78 of the annular chamber rim 14*e*. A pin 79 extending between the tabs 76*a* and 76*b* pivotally mount a connector shaft or swing bolt 80 for pivotal movement into camming engagement with a camming lug 81 adapted to be welded into the exterior surface 82 of the end portion 10*a* of the chamber D or H. The camming lug 81 is also U-shaped and thus includes spaced tabs (81*a* only being shown) adapted to receive therebetween the swinging bolt 80. A camming nut 83 is mounted onto the threaded end portion 80*a* of swing bolt 80 and is tightened to engage the inclined surface 81*c* of each of the tabs 81*a* of the camming lug 81.

In this manner, once the chamber C has been aligned so that the face 71 on annular rim 14*e* is fully aligned with annular face 70 on the other chamber end section or rim 10*a*, the swing bolts 80 are rotated into a locking position in the camming lugs 81 and the bolts 83 are tightened against face 81*c* so that the internal face of the bolts 83 frictionally engage the inclined surface 81*c* and interconnect the two chambers.

A stretcher S of any suitable shape is supportable within the chamber C by the stretcher support assembly 20. The stretcher support assembly 20 includes a stretcher support frame 90 which is generally rectangular as viewed from the top as in FIG. 8 and includes longitudinally extending support members 91*a* and 91*b* which are interconnected by transversely extending end members 91*c* and 91*d*, the member 91*d* having a handle 92 mounted thereon. The longitudinal support members 91*a* and 91*b* include a ledge 92*a* which actually supports the stretcher S. The longitudinal support members 91*a* and 91*b* further include a vertically extending or depending portion 92*b* having mounted thereon guide or cam follower members 92*c* and 92*d*. The guide members 92*c* and 92i d on each of the support members 91*a* and 91*b* extend longitudinally and rollingly engage a plurality of rollers or runners 93 mounted onto spaced angular supports 94, which are mounted at longitudinally spaced intervals in the chamber. In this manner, the stretcher support assembly 20 including the longitudinally directed support members 91*a* and 91*b* are mounted for movement from a retracted position within the chamber C to an extended position extending through the manway 18 outwardly of the chamber C so that an injured person positioned on a stretcher S can be moved into and out of the chamber C.

The deck chamber D and the hospital chamber H have both been described as having an annular end portion or reinforcement ring 10*a* which is matable with the end portion or rim 14*e* on the chamber C. It is anticipated that there will be situations where the chamber C is not directly attachable to the deck chamber D or hospital chamber H because such a chamber does not have an end section which is of the same size as the rim 14*e* on the chamber C. An example of such a chamber D-1 is illustrated in FIG. 10 wherein the deck or hospital chamber includes an end section 100 terminating in an annular reinforcement ring 101 which is larger than the end rim or section 14*e* of the chamber C and thus cannot be aligned therewith.

In order to interconnect the chamber C with such a deck or hospital chamber as illustrated in FIG. 10, it is necessary to provide an adapter 110 which provides an end surface 11O*a* which is of substantially the same size as the end surface 71 of the annular end section 14*e* of chamber C. The seal adapter 110 includes a cylindrical extender sleeve 111 having a main sleeve cylindrical section 111*a* having an outside diameter slightly less than the diameter of the chamber reinforcement ring 101 so that the cylindrical sleeve section 111*a* is insertable into the reinforcement ring 101. The extender sleeve 111 is held in a transverse, extending position by an internal annular mounting ring 112 which includes two semi-annular sections 112*a* and 112*b* which mate together and fit against the internal annular face 101*a* of the reinforcement ring 101 on the chamber D-1. A series of circumferentially spaced mounting bolts 114 extend through the internal mounting ring sections 112*a* and 112*b* into threaded engagement with the end 111*b* of the extender sleeve section 111*a* in order to mount the sleeve in its extended position. Seals are provided in the internal mounting ring semi-annular portions 112*a* and 112*b* as assembled in order to sealingly engage the interior face 101*a* of the reinforcement ring 101 and the mounting end face 111*b* of the extender sleeve 111. The extender sleeve 111 further includes a flange portion 111*c* formed integrally with and extending outwardly from the sleeve 111*a* at about its midpoint. A plurality of mounting bolts 115 extends through the flange 111*c* and are in threaded engagement with the flange. The bolts 115 are rotated into engagement with the outer face 101*b* of the reinforcement ring 101 in order to cooperate with the internal mounting ring 112 to mount the extender sleeve 111 in its transversely extending position. The connector lugs 81 are welded onto the end of the extender sleeve 111 in order to receive the swing bolts 80 and actually connect the seal adapter 110 to the end of the chamber C. It is contemplated that the seal adapter 110 may be sized to fit within the reinforcement ring 101 of various size vessels.

In operation and use of the chamber C, the chamber C is flown or otherwise transported to the scene of an injury, or it may be stored on such scene such as on the deck of a ship or an offshore oil platform. When an injury occurs, the chamber C is mated up with a deck chamber D so that the injured diver can be moved into the chamber C (or the injured diver can be placed directly in chamber C) and kept at hyperbaric pressures after closure of the pressure safe door 19 for transportation of the chamber C to a hospital or other site having a larger hospital chamber H. The chamber C is then mated up with such a chamber H and the diver is removed after the pressures across the two hyperbaric chambers have been equalized so that the diver is now safely in larger, hyperbaric quarters so that he may be treated for a more extended period.

The foregoing disclosure and description of the invention are illustrative and explanatory thereof, and various changes in the size, shape and materials as well as in the details of the illustrated construction may be made without departing from the spirit of the invention.

We claim:

1. A transportable hyperbaric life support chamber, comprising:

a transportable hyperbaric chamber which is generally cylindrical in configuration having a first end, an opposite second end and being of sufficient width and length to receive an injured person, said chamber having a manway opening at said first end being of sufficient diameter to receive an injured person;

chamber interconnection means at said first end of said transportable hyperbaric chamber for temporarily connecting said manway opening of said transportable hyperbaric chamber first to a manway opening of a deck chamber so that an injured person can be transferred from such deck chamber through said manway opening to said transportable hyperbaric chamber and subsequently to a manway opening of a hospital chamber so that such injured person can be transferred out of said transportable hyperbaric chamber to said hospital chamber;

a chamber support platform including means for mounting said transportable hyperbaric chamber thereon and for supporting said manway opening of said transportable hyperbaric chamber in an aligned position with respect to the manway openings of said deck chamber and said hospital chamber;

a pressure safe chamber door and means mounting said pressure safe door for movement between a closed position in a sealed connection over said transportable chamber manway opening and an open position fully out of said manway opening so that an injured person can be transferred therethrough;

a stretcher support assembly mounted in said transportable chamber and extension mounting means for moving said stretcher support assembly from a retracted position in said transportable chamber to an extended position in which said stretcher support assembly extends through said manway opening and into said deck or hospital chamber for transferring a patient when said transportable chamber and deck or hospital chamber are temporarily connected;

said transportable chamber having at said first end a wall end section transversely directed with respect to the longitudinal axis of said transportable chamber and having said manway opening formed therein;

said pressure safe door having a configuration and size larger than said manway opening, a door arm connected to said pressure safe door; and being positioned inside of said chamber and said transverse wall section, said pressure safe door having a peripheral outside surface portion having a sealing member mounted in said surface for sealingly engaging the inside of said transversely directed chamber wall end section with said door in a closed position;

first and second pivot mounting means mounted with said transverse wall end section and with said door and being interrelated to move said door from a closed position in which said door is transversely positioned with respect to the longitudinal axis of said chamber; and is sealed against said chamber transverse wall end section to an open position in which said door is pivoted to a position out of the path through said manway opening with said door being parallelly oriented with respect to the longitudinal axis of said chamber;

said first pivot means being attached to said door arm and to said transverse wall end section of said transportable chamber mounting said door arm for pivotal movement between a first position in which said door arm is positioned transversely to the longitudinal axis of said chamber and a second position in which said door arm is positioned approximately parallel with respect to the longitudinal axis of said chamber;

said second pivot means attached to said pressure safe door and to said door arm mounting said pressure safe door for pivotal movement with respect to said door arm;

a lockable link and link mount means mounting said lockable link on said transverse wall section for pivotal movement;

removable link set means for setting said link in a transversely extending position in which a portion of said link extends into the path of said manway opening, said lockable link being movable to a withdrawn position out of the path of said manway opening when said link set means is removed;

a matching latch element mounted on said pressure door; and a lock handle assembly mounted onto said lockable link for pivotal movement with respect to said link, said lock handle assembly including latch means extending longitudinally into said manway opening in said transverse chamber wall section and into locking engagement with said mating latch element mounted on said pressure safe door.

2. The structure set forth in claim 1, wherein said chamber support platform includes:

a support dolly having a plurality of support arms providing oppositely inclined support surfaces;

said transportable chamber being positioned on said support surfaces; and vertical position adjustment means for adjusting the relative vertical position of said support surfaces in order to adjust and align the position of the manway opening of said transportable chamber with respect to the manway opening of said deck or hospital chamber.

3. The structure set forth in claim 2, including:

said support dolly includes a generally rectangular main frame mounted on wheels, said main frame including oppositely positioned, longitudinally directed main frame members connected by transverse frame members;

intermediate frame members also oppositely positioned and longitudinally directed and being interconnected by transverse frame members, said support arms being mounted thereon; and said vertical position adjustment means including vertically adjustable shaft supports mounted at longitudinally spaced positions with said oppositely positioned main frame members; and pivotal connection means mounted with each of said shaft supports for connecting said vertically adjustable shaft supports to said intermediate longitudinal frame members for pivotal movement with respect thereto.

4. The structure set forth in claim 3, including:

said vertical position adjustment means including first and second sets of said vertically adjustable shaft supports, one of said sets being positioned proximate to said first end of said transportable chamber and the other of said sets being positioned proximate the opposite second end of said chamber.

5. The structure set forth in claim 1, wherein said chamber interconnection means includes:

said first end of said transportable chamber having said manway opening being adapted to be aligned with the manway opening of said deck or hospital chamber;

said first end of said transportable chamber terminating in a peripheral mounting rim having a cross-sectional configuration adapted to be aligned with the manway opening of said deck or hospital chamber;

seal means mounted with said peripheral mounting rim adapted to sealingly engage the manway opening of said deck or hospital chamber; and a plurality of circumferentially spaced camming connectors mounted on said peripheral mounting rim for connecting the manway opening of said transportable chamber to the manway opening of said deck or hospital chamber.

6. The structure set forth in claim 5, including:

each of said spaced camming connectors including a connector shaft mounted on said peripheral mounting rim for pivotal movement;

a camming lug adapted to be mounted on said deck or hospital chamber; and said connector shaft having a camming member mounted thereon, said camming member having a camming surface for engaging said camming lugs to connect said chambers together.

7. The structure set forth in claim 6, including:

each of said camming connectors including spaced tabs mounted on said peripheral mounting rim of said chamber;

said connector shaft being a swing bolt;

mounting means mounting said swing bolt between said spaced tabs;

said camming member being a swing nut threadedly mounted on said swing bolt; and each of said camming lugs including an inclined camming surface for receiving said swing nut to interconnect the manway opening of said transportable chamber with the manway opening of said deck or hospital chamber.

8. The structure set forth in claim 5, including a vessel connector adapter means for mounting into the manway opening in said deck or hospital chamber and providing an annular end portion of a designated size for mating with said peripheral mounting rim of said transportable chamber, said vessel connector adapter means comprising:

a main cylindrical extender sleeve including a main cylindrical sleeve section having a hollow bore therethrough and having an outside diameter slightly less than the diameter of the manway opening in said deck or hospital chamber so that said main cylindrical extender sleeve is insertable into said deck or hospital chamber manway opening;

adapter mount means attached to said cylindrical sleeve for engagement with the inside of said deck or hospital chamber at said manway opening and for engagement with the outside of said deck or hospital chamber at said manway opening in order to firmly mount said cylindrical extender sleeve in engagement with said deck or hospital chamber at said manway opening; and a plurality of camming lugs mounted on said main cylindrical extender sleeve for receiving said spaced camming connectors.

9. The structure set forth in claim 8, wherein said adapter mount means further includes:

said main cylindrical extender sleeve having a flange portion mounted on the outside surface thereof and adapted to be positioned in alignment with but spaced from the outside of said deck or hospital chamber at said manway opening;

an internal mounting ring positioned inside of said deck or hospital chamber manway opening; and a plurality of mounting shafts extending through said flange into engagement with the outside of said deck or hospital chamber at said manway opening in order to hold said internal mounting ring in engagement with the inside of said deck or hospital chamber at said manway opening.

10. The structure set forth in claim 1, including:

said lock handle assembly including a shaft pivotally mounted with said lockable link and extending longitudinally into said manway opening;

a handle mounted at one end of said shaft for rotating said shaft; and a latch element mounted on the other end of said shaft and being positioned adjacent to the exterior of said pressure safe door, said latch element being pivotal with said shaft for movement into latched engagement with said mating latch element mounted onto said pressure safe door.

* * * * *

UNITED STATES PATENT AND TRADEMARK OFFICE

CERTIFICATE OF CORRECTION

PATENT NO. : 4,467,798

DATED : August 28, 1984

INVENTOR(S) : Ross E. Saxon; W. Robert Bryant

It is certified that error appears in the above-identified patent and that said Letters Patent is hereby corrected as shown below:

In Column 7, Line 43, please delete "92i d" and insert therefor --92d--.

Signed and Sealed this

*Nineteenth* Day of *February 1985*

[SEAL]

*Attest:*

DONALD J. QUIGG

*Attesting Officer* *Acting Commissioner of Patents and Trademarks*